US012668449B2

(12) United States Patent
Takemoto et al.

(10) Patent No.: US 12,668,449 B2
(45) Date of Patent: Jun. 30, 2026

(54) STACKER AND MACHINING PROCESSING DEVICE

(71) Applicant: DUPLO SEIKO CORPORATION, Kinokawa (JP)

(72) Inventors: Haruka Takemoto, Kinokawa (JP); Kohei Tomioka, Kinokawa (JP); Tomoyuki Nagayama, Kinokawa (JP); Masamichi Saika, Kinokawa (JP)

(73) Assignee: DUPLO SEIKO CORPORATION, Kinokawa (JP)

( * ) Notice: Subject to any disclaimer, the term of this patent is extended or adjusted under 35 U.S.C. 154(b) by 0 days.

(21) Appl. No.: 18/957,993

(22) Filed: Nov. 25, 2024

(65) Prior Publication Data

US 2025/0361108 A1 Nov. 27, 2025

(30) Foreign Application Priority Data

May 24, 2024 (JP) ..... 2024-084445

(51) Int. Cl.
*B65H 31/20* (2006.01)
*B65H 7/02* (2006.01)
(Continued)

(52) U.S. Cl.
CPC ..... *B65H 31/28* (2013.01); *B65H 7/02* (2013.01); *B65H 7/20* (2013.01); *B65H 29/14* (2013.01); *B65H 35/0073* (2013.01); *B65H 39/06* (2013.01); *B65H 43/06* (2013.01); *B65H 2301/435* (2013.01); *B65H 2404/154* (2013.01); *B65H 2404/256* (2013.01); *B65H 2404/722* (2013.01); *B65H 2404/7412* (2013.01)

(58) Field of Classification Search
CPC .... B65H 31/20; B65H 31/3054; B65H 31/02; B65H 31/34; B65H 31/36; B65H 31/28; B65H 39/006; B65H 2301/4217; B65H 2301/42172; B65H 2301/4222; B65H 2511/15; B65H 33/08
See application file for complete search history.

(56) References Cited

U.S. PATENT DOCUMENTS

2016/0332839 A1* 11/2016 Herrmann ..... B65H 31/3081
2018/0086586 A1* 3/2018 Oguri ..... B65H 31/10
(Continued)

FOREIGN PATENT DOCUMENTS

JP 2012162384 A 8/2012
JP 2017186142 A 10/2017

OTHER PUBLICATIONS

The extended European Search Report issued on May 23, 2025, by the European Patent Office in corresponding European Application No. 24214887.2. (9 pages).

*Primary Examiner* — Luis A Gonzalez
(74) *Attorney, Agent, or Firm* — BUCHANAN INGERSOLL & ROONEY PC

(57) ABSTRACT

A stacker includes a placement part that stacks thereon sheets discharged from a discharge port by a conveyor that conveys the sheets; a side guide that regulates edges of the sheets in a width direction intersecting a discharge direction of the sheets; a guide driver that moves the side guide along the width direction; and a controller configured to control the guide driver to position the side guide at a position where the sheet discharged from the discharge port is supported from below by the side guide.

7 Claims, 14 Drawing Sheets

(51) Int. Cl.

| | |
|---|---|
| ***B65H 7/20*** | (2006.01) |
| ***B65H 29/14*** | (2006.01) |
| ***B65H 29/34*** | (2006.01) |
| ***B65H 31/28*** | (2006.01) |
| ***B65H 31/30*** | (2006.01) |
| ***B65H 35/00*** | (2006.01) |
| ***B65H 39/06*** | (2006.01) |
| ***B65H 43/06*** | (2006.01) |

(56) References Cited

U.S. PATENT DOCUMENTS

| | | | | |
|---|---|---|---|---|
| 2019/0127174 | A1 | 5/2019 | Ohata et al. | |
| 2022/0281702 | A1 | 9/2022 | Yanagisawa et al. | |
| 2023/0303357 | A1* | 9/2023 | Takemoto ..... | B65H 33/00 |

* cited by examiner

STACKER AND MACHINING PROCESSING DEVICE

BACKGROUND

Technical Field

The present disclosure relates to a stacker having a placement part for receiving and stacking thereon sheets discharged, and to relates a machining processing device.

Background Art

In the past, as shown in JP2017186142A, for example, a procedure has been performed in which sheets are cut while being conveyed to create lined-up pieces of the sheets, which pieces are then stacked on a placement table with their side edges regulated by guides.

In the conventional devices, however, sheets processed by the cutting part and discharged from the discharge port by the conveyor may not be stacked correctly in the placement part. In this case, the type of sheets discharged is particularly influential. For example, if the length of the sheets in the conveyance direction is short, the sheets discharged from the discharge port by the discharge rollers may not completely reach the placement part and may be piled up disorderly near the discharge port. Also, if the sheets are thin, they may be stacked in a wrinkled state in the placement part.

SUMMARY

An object of the present disclosure is to provide a stacker capable of improving the performance of aligning sheets stacked in the placement part.

A stacker according to an aspect of the present disclosure, includes:

- a placement part that stacks thereon sheets discharged from a discharge port by a conveyor that conveys the sheets;
- a side guide that regulates edges of the sheets in a width direction intersecting a discharge direction of the sheets;
- a guide driver that moves the side guide along the width direction; and
- a controller configured to control the guide driver to position the side guide at a position where the sheet discharged from the discharge port is supported from below by the side guide.

A machining processing device according to the present disclosure includes:

- a conveyor that conveys sheets;
- a cutting part that cuts the sheets conveyed by the conveyor along a conveyance direction;
- a placement part that stacks thereon the sheets cut by the cutting part and discharged from a discharge port by the conveyor;
- a side guide that regulates edges of the sheets in a width direction intersecting a discharge direction of the sheets;
- a guide driver that moves the side guide in the widthwise direction; and
- a controller configured to control the guide driver to position the side guide at a position where the sheet discharged from the discharge port is supported from below by the side guide.

According to the first aspect of the present disclosure, the performance of aligning the sheets stacked in the placement part can be improved.

DETAILED DESCRIPTION

Figure 1:
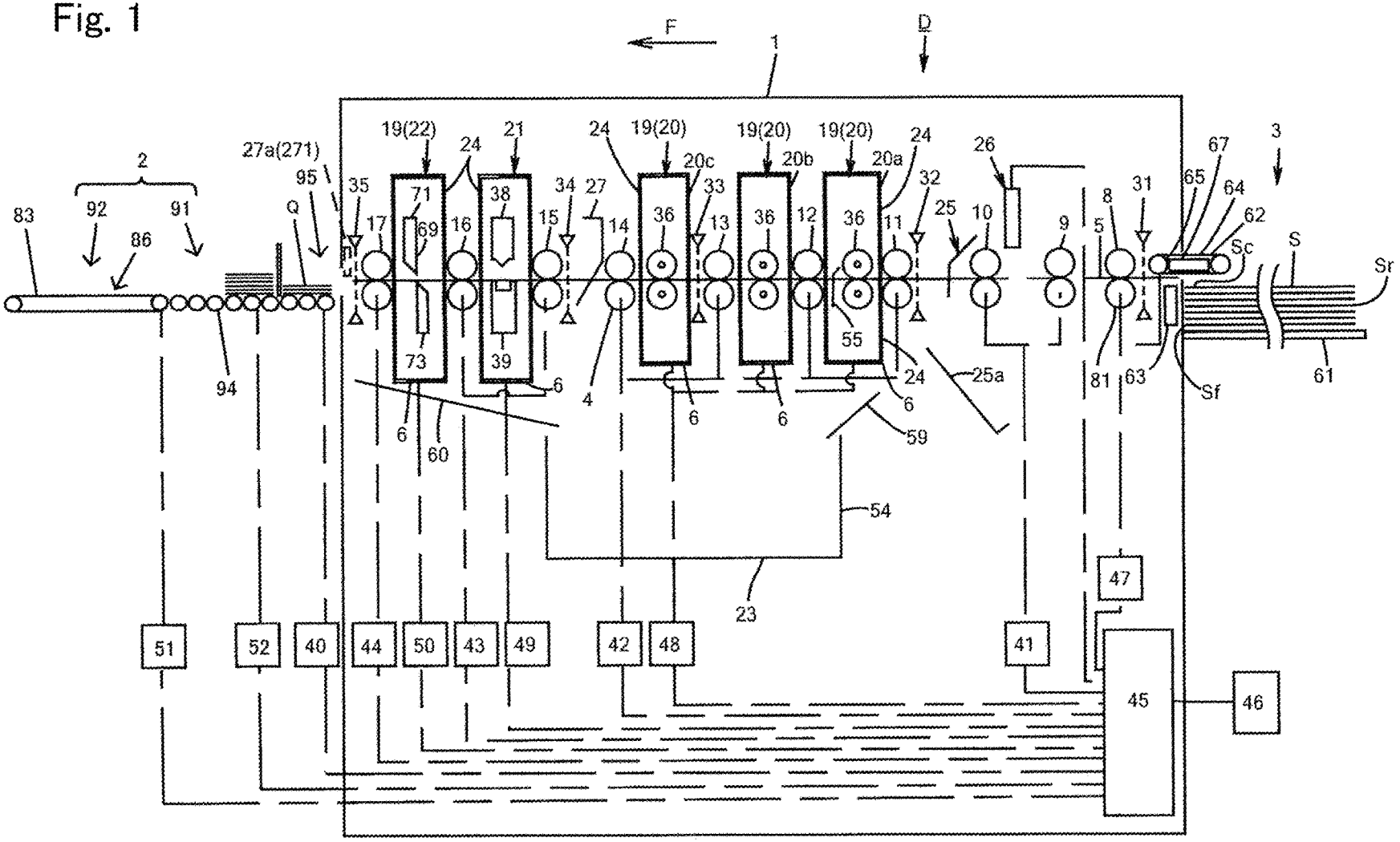
FIG. 1 is a longitudinal sectional view showing a schematic configuration of a machining processing device according to an embodiment.

A stacker according to the first aspect of the present disclosure includes:

- a placement part that stacks thereon sheets discharged from a discharge port by a conveyor that conveys the sheets;
- a side guide that regulates edges of the sheets in a width direction intersecting a discharge direction of the sheets;
- a guide driver that moves the side guide along the width direction; and
- a controller configured to control the guide driver to position the side guide at a position where the sheet discharged from the discharge port is supported from below by the side guide.

According to the first aspect of the present disclosure, the performance of aligning the sheets stacked in the placement part can be improved irrespective of the type of sheets discharged from the discharge port.

The stacker according to the second aspect of the present disclosure, in the first aspect, includes a level sensor, wherein when the level sensor detects that the sheets stacked in the placement part have reached a predetermined height, the controller controls the guide driver to move the side guide to a position where the side guide does not support the sheet from below.

According to the second aspect of the present disclosure, the sheet alignment performance can be improved even after the height of sheets stacked in the placement part reaches a predetermined height.

The stacker according to the third aspect of the present disclosure, in the second aspect, wherein when the level sensor detects, continuously a predetermined amount, that the sheets have reached the predetermined height, the controller controls the guide driver to move the side guide to the position where the side guide does not support the sheet from below.

According to the third aspect of the present disclosure, erroneous detection by the level sensor can be prevented.

The stacker according to the fourth aspect of the present disclosure, in the second aspect, wherein the side guide comprises a first side guide and a second side guide arranged adjacent to each other in the width direction, and the controller controls the guide driver, when supporting the sheet from below, so that one side edge of the sheet is supported by the first side guide and that the second side guide lies at a position a predetermined length apart from the other side edge of the sheet.

According to the fourth aspect of the present disclosure, the performance of aligning the sheets stacked in the placement part can further be improved.

The stacker according to the fifth aspect of the present disclosure, in the fourth aspect, wherein the controller is configured to control the guide driver to execute jogger action to align the side edges of the sheets, and prior to starting the jogger action, the controller controls the guide driver to move the first side guide from a position supporting one side edge of the sheet to a position a predetermined length apart from the one side edge of the sheet.

According to the fifth aspect of the present disclosure, the performance of aligning the sheets stacked in the placement part can even further be improved.

The stacker according to the sixth aspect of the present disclosure, in the fifth aspect, includes an abutment guide disposed in the placement part, for regulating leading edges of the sheets, wherein prior to starting the jogger action, the controller controls the guide driver to move the abutment guide to a retracted position apart a predetermined length from the leading edges of the sheets.

According to the sixth aspect of the present disclosure, the performance of aligning the leading edge of the sheets can be improved.

The stacker according to the seventh aspect of the present disclosure, in the first aspect, wherein the side guide is configured so that a user is allowed to select whether to position the side guide at a position where the sheet is supported from below by the side guide.

According to the seventh aspect of the present disclosure, the position of the side guide can be set by the user.

A machining processing device according to the eighth aspect od the present disclosure includes:

a conveyor that conveys sheets;

a cutting part that cuts the sheets conveyed by the conveyor along a conveyance direction;

a placement part that stacks thereon the sheets cut by the cutting part and discharged from a discharge port by the conveyor;

a side guide that regulates edges of the sheets in a width direction intersecting a discharge direction of the sheets;

a guide driver that moves the side guide in the widthwise direction; and a controller configured to control the guide driver to position the side guide at a position where the sheet discharged from the discharge port is supported from below by the side guide.

According to the eighth aspect of the present disclosure, the performance of aligning the sheets stacked in the placement part can be improved irrespective of the type of the sheets discharged from the discharge port.

[Overall Configuration of Machining Processing Device D]

A schematic overall configuration of a machining processing device D will be described with reference to the drawings. In the following description, the direction orthogonal to a conveyance direction F of a conveyor 4 conveying a sheet S is referred to as a width direction W, and the right side and the left side when viewed from the upstream side toward the downstream side in the conveyance direction F are referred to respectively as the right side and the left side of the device. FIG. 1 is a diagrammatic longitudinal sectional view of the machining processing device D. In FIG. 1, the machining processing device D includes: a feeder 3 disposed at the upstream end of a main body 1 in the conveyance direction F of the sheet S (cut sheet Q); and a sorter 2 disposed at the downstream end in the conveyance direction F, in which the cut sheets Q i.e. sheets obtained by the machining process are placed. A substantially horizontal conveyance path extends between the feeder 3 and the sorter 2.

The sorter 2 includes both a stacking device that receives and stacks sheets S, and a conveying device that conveys the sheets S stacked downstream. The stacking device receives sheets S continuously discharged in one or more rows in the width direction W of the sheets S and stacks the sheets S in a sorted state. The conveying device includes a stacking conveyor 91 that receives sheets S continuously discharged in one or more rows in the width direction and conveys the sheets S stacked in a sorting unit downstream. The term "sheet" refers primarily to paper products, but is not limited purely to paper products, and also includes various plastic sheets and films.

The conveyance path 5 is equipped with a conveyor 4 in which a plurality of roller pairs 9 to 17 each includes upper and lower rollers are disposed. The rollers 9 to 17 are arranged at intervals in the conveyance direction F. The rollers 9 to 17 making up the conveyor 4 are connected via power transmission mechanisms (not shown) to conveyor drivers 41 to 44, respectively, which are electrically connected to a controller 45.

A machining processing part 24 processing the conveyed sheet S is disposed on the conveyance path 5. In FIG. 1, the machining processing part 24 includes a cutting part 19 and a creaser 21 that forms a crease orthogonal to the conveyance direction F. The cutting part 19 includes three sets of slitters 20 and a cutter 22.

The slitters 20, creaser 21, and cutter 22 are each configured as a detachable unit, allowing detachment at a desired position in the main body 1 by a cassette system. Hence, depending on the type of processing, the order of arrangement of the slitters 20, creaser 21, and cutter 22 can be changed, or they can be replaced with or add on to another machining processing part 24, such as a mechanism for forming a crease along the conveyance direction F, a chamfering mechanism, or a perforating mechanism.

A reader 26 and a rejector 25 are disposed upstream of the slitters 20, while a cutting-scrap removal mechanism 27 is disposed downstream of the slitters 20. A cutting-scrap collection part 23 is disposed at the bottom inside the main body 1.

A plurality of light transmission sensors 31 to 35 for detecting a leading edge (downstream edge) Sf or a trailing edge (upstream edge) Sr of the sheet S are additionally arranged on the conveyance path 5 and each electrically connected to an interface of the controller 45. The first sensor 31, which is the most upstream sensor in the conveyance direction F of the sheet S, is disposed between a suction conveyor 62 and a feed roller pair 8 of the feeder 3, the next second sensor 32 is disposed in the upstream vicinity of the slitters 20, the next third sensor 33 is disposed halfway through the slitters 20, the next fourth sensor 34 is disposed in the upstream vicinity of the creaser 21, and the fifth sensor 35, which is the most downstream sensor, is disposed in the upstream vicinity of the stacker part i.e. sorter 2.

The first sensor 31 detects the leading edge Sf of the sheet S before the sheet S is gripped by the feed roller pair 8 after being sucked and conveyed by the suction conveyor 62 of the feeder 3, or the trailing edge Sr of the sheet S after the sheet has been gripped and conveyed by the feed roller pair 8, and is used to calculate the position of the sheet S as it is subsequently being conveyed on the conveyance path 5 based on the detected position of the sheet S as a reference.

The second sensor 32 and the third sensor 33 detect jamming of the sheet S during processing. The fourth sensor 34 is disposed as an auxiliary to correct the sheet position information obtained by the first sensor 31 to make the sheet position information more accurate in case the conveyance path 5 becomes longer with the result that a positional deviation (conveyance error) in the conveyance direction F of the sheet S accumulates during processing on the conveyance path 5. The fifth sensor 35 detects the discharge of the processed cut sheets Q into the sorter 2. The fifth sensor 35 also detects a jam of the cut sheets Q in the sorter 2.

[Feeder 3]

The feeder 3 includes a feed table 61, the feed rollers 8, the suction conveyor 62, and a separation air blowing part 63. The feed table 61 is disposed to have sheets S stacked up thereon and to feed the sheets S onto the conveyance path 5. The feed table 61 can be raised and lowered by a lifter (not shown). When feeding sheets S, the lifter raises the feed table 61 from a standby position to a feed position at a predetermined height where the topmost sheet S can be sucked and conveyed by the suction conveyor 62 to be fed onto the conveyance path 5. Thus, the feed table 61 is movable between the standby position and the feed position.

The feed roller pair 8 includes upper and lower feed rollers. The suction conveyor 62 includes a suction fan 67, a conveyance belt 64, and a belt roller pair 65. In the feeder 3, a predetermined number of sheets S stacked on the feed table 61 are fed onto the conveyance path 5 one by one from the top using the suction conveyor 62 and the feed roller pair 8 including the upper and lower feed rollers.

The separation air blowing part 63 blows air toward the leading edges Sf of the sheets S on the feed table 61 using a fan (not shown) and separates the topmost sheet S from the sheets S stacked, to allow the suction conveyor 62 to suck it for conveyance. One roller of the belt roller pair 65 and a lower feed roller 81 of the feed roller pair 8 are connected to a paper feed driver 47. The separation air blowing part 63, the suction fan 67, and the paper feed driver 47 are electrically connected to the controller 45.

[Reader 26]

Figure 2:
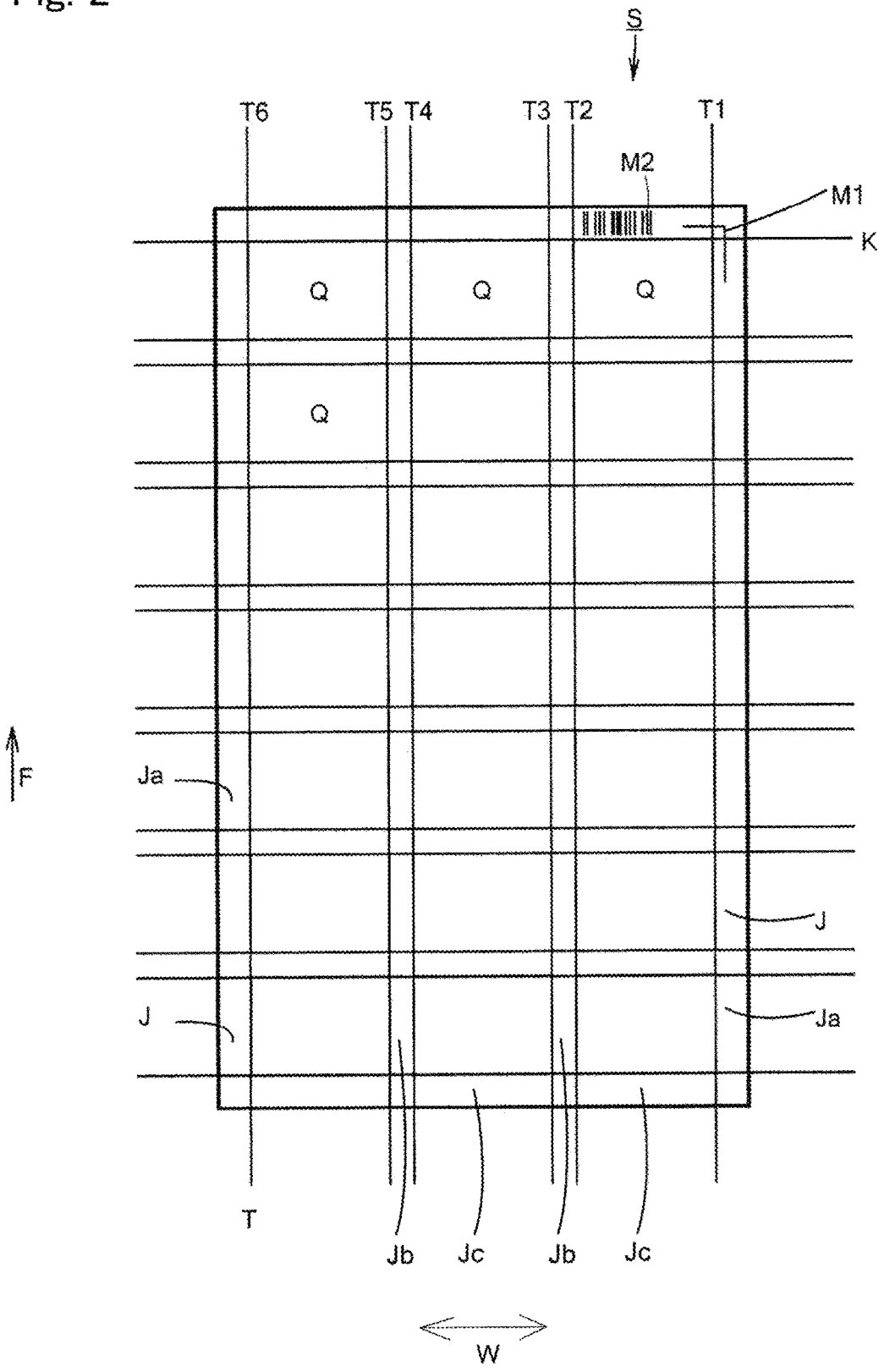
FIG. 2 is a plan view showing an example of a machining process pattern of a sheet.

The reader 26 reads an image of a position mark M1 printed on a front corner of the sheet S as shown in FIG. 2 and detects a reference position for processing in the conveyance direction F of the sheet S and in the width direction W orthogonal to the conveyance direction F. The reader 26 may be configured also as an input part that automatically reads and sets processing information, separately from the manual input of various pieces of processing information through an operation panel 46. Specifically, the reader 26 reads an image of a barcode M2 printed on the leading edge of the sheet S as shown in FIG. 2, to obtain various pieces of processing information to be applied to the sheet S. The reader 26 may configured with a CCD sensor or the like.

[Rejector 25]

The rejector 25 in FIG. 1 acts on the sheet S when the position mark M1 or barcode M2 printed on the sheet S is unclear and cannot be read by the reader 26, causing the unreadable sheet S to fall and be collected in the tray 25*a*.

[Slitter 20]

The slitter 20 includes three units arranged side by side in the conveyance direction F, each unit having two cutting blade pairs 36 spaced apart from each other in the width direction W, each cutting blade pair consisting of upper and lower rotary cutting blades. The cutting blade pairs 36 are arranged movably in a direction intersecting the conveyance direction F of the conveyor 4 and constitute processing members that perform predetermined processing for the conveyed sheet S at predetermined positions thereon. The cutting blades 36 on either the upper side or the lower side of the conveyor path 5 are rotated by the driving force of a rotation driver 48 serving as a processing member driver that drives the processing members, the other cutting blades 36 being followingly rotated, thereby cutting the sheet S along the conveyance direction F of the conveyor 4 to form a cutting line T on the sheet S.

[Creaser 21]

The creaser 21 includes a lower die 39 having a concave portion at the top end and an upper die 38 having a convex portion at the bottom end that fits into the concave portion, the upper die 38 being coupled via a power transmission mechanism to a creaser driver 49 such as a motor. That is, by lowering the upper die 38 with the driving force of the creaser driver 49, a crease is formed on the sheet S in the width direction W orthogonal to the conveyance direction F.

[Cutter 22]

The cutter 22 has a pair of cutting blades 69 extending in the width direction W and facing each other. One cutting blade 69 is configured with an upper movable blade 71 and the other cutting blade 69 is configured with a lower fixed blade 73. The upper movable blade 71 comes into contact with and separates from the lower fixed blade 73 to cut the sheet S in the width direction W orthogonal to the conveyance direction F, forming a cutting line K on the sheet S. The upper movable blade 71 is connected via a power transmission mechanism to a cutter driver 50 such as a motor.

[Sorter 2]

The sorter 2 includes the stacking conveyor 91 and a stacker 92. The stacking conveyor 91 receives by a placement part 95 the processed cut sheets Q continuously discharged from the main body 1 (machining processing part 24) and stacks them in a sorting unit. The cut sheets Q stacked in a sorting unit are hereinafter referred to as stacked sheets Q'. The stacking conveyor 91 continuously conveys the stacked sheets Q' downstream. The stacking conveyor 91 includes a plurality of rollers (drive rollers) 94. The stacked sheets Q' are loaded on the rollers 94. The stacker 92 is disposed downstream of the stacking conveyor 91. The stacker 92 continuously stacks the stacked sheets Q' conveyed from the stacking conveyor 91 at different positions on the placement surface in a sorted manner. The stacker 92 includes a placement part 83 that allows the stacked sheets Q' to be stacked at different positions on the placement surface in a sorted manner. The placement part 83 includes a belt conveyor 86 having a circulating belt 85 on which the stacked sheets Q' are loaded. The stacked sheets Q' conveyed from the stacking conveyor 91 are placed on the belt conveyor 86 while being conveyed.

The stacking conveyor 91 and the stacker 92 are driven independently of each other to convey the stacked sheets Q'. A roller driver 40 is electrically connected to the controller 45, which controls the drive amount of the roller driver 40 to thereby adjust the rollers 94 to roll at a predetermined velocity. A conveyor driver 51 is electrically connected to the controller 45, which controls the drive amount of the conveyor driver 51 to thereby adjust the belt conveyor 86 to run at a predetermined velocity. The sorter 2 also includes, as another driver, a guide driver 52 that drives an abutment guide 93 and side guides 961 to 964 in the placement part, the guide driver 52 being electrically connected to the controller 45.

The specific configuration and action of the sorter 2 will be described later.

[Cutting-Scrap Collection Part 23]

The cutting-scrap collection part 23 includes a cutting-scrap storage box 54 and guides 59 and 60. The cutting-scrap storage box 54 is formed in a rectangular parallelepiped shape with an opening at the top. The cutting-scrap storage box 54 collects and stores cutting scraps J that have been cut off in the cutting part 19 and are no longer needed. The guides 59 and 60 guide into the cutting-scrap storage box 54 the cutting scraps J that have been cut off in the cutting part 19 to fall.

[Controller 45]

Figure 9:
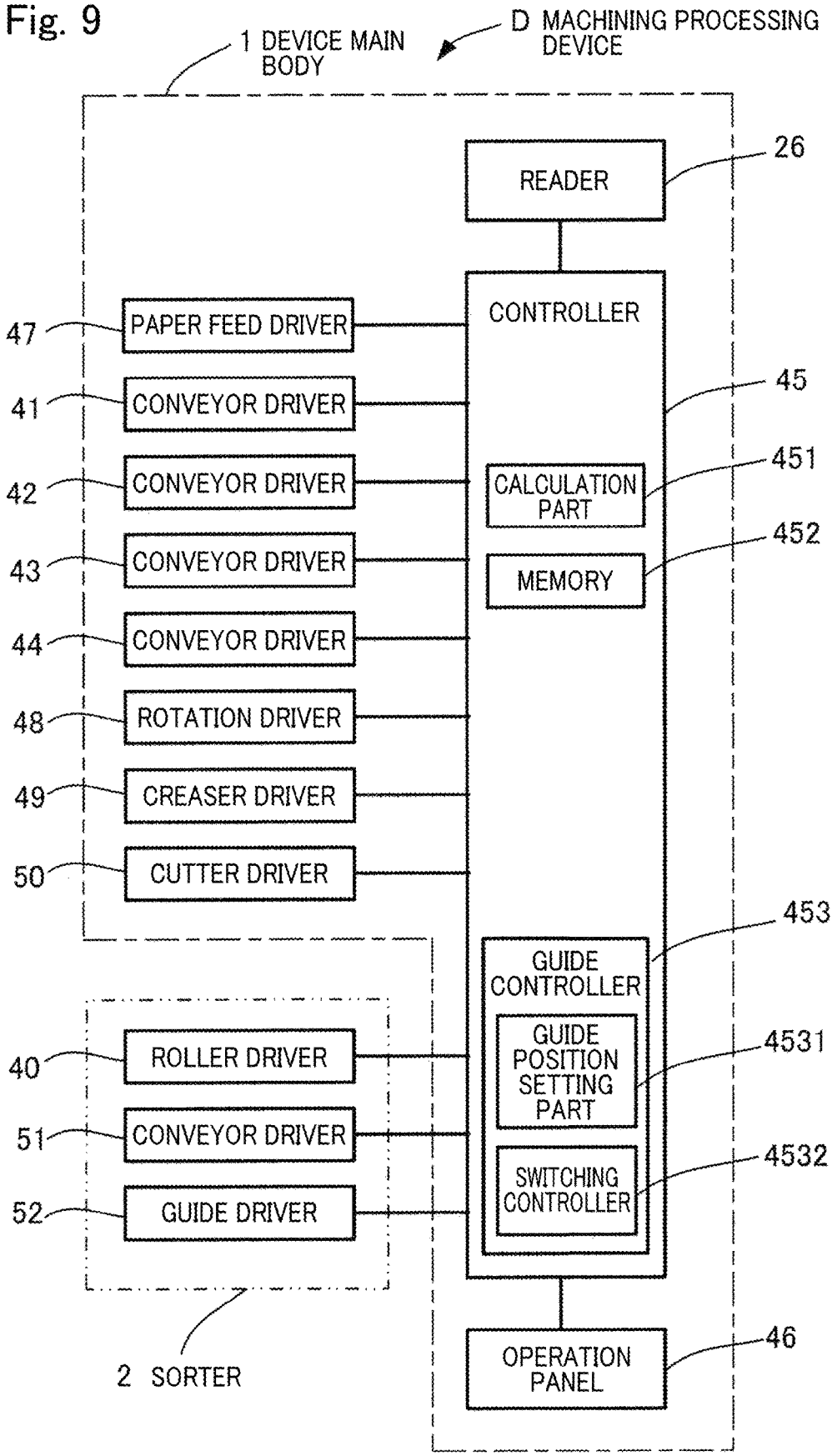
FIG. 9 is a block diagram showing an electrical configuration of the machining processing device.

FIG. 9 is a block diagram showing an electrical configuration of the machining processing device D. The main body 1 of the machining processing device D includes the controller 45. The controller 45 includes a calculation part 451 and a memory 452 and controls action of the entire machining processing device D. The calculation part 451 is, for example, a CPU. The memory 452 includes storage media such as ROM, RAM, and EEPROM. The calculation part 451 reads and executes a control program stored in the memory 452, to implement functions of the controller 45. The controller 45 includes a guide controller 453 that controls action of the guide driver 52. In this case, in addition to the main control CPU (calculation part 451), a control CPU exclusively controlling the sorter 2 under the control of the main control CPU may separately be disposed, and the two CPUs may be configured to communicate with each other.

The operation panel 46 and the reader 26 are electrically connected to the controller 45; the paper feed driver 47, the conveyor drivers 41 to 44, the rotation driver 48, the creaser driver 49, and the cutter driver 50 are further connected as the drivers built in the main body 1 to the controller 45; and the roller driver 40, the conveyor driver 51, and the guide driver 52 are further connected as the drivers built in the sorter 2 to the controller 45.

The controller 45 controls action of the entire machining processing device D. The controller 45 acquires information from the sensors 31 to 35 and controls drive of the feeder 3, the conveyor 4, the sorter 2, and the machining processing part 24 based on the cutting information of the sheet S input by the operation panel 46 or the reader 26 acting as a cutting information input part, thereby processing the sheet S. The operation panel 46 serves both as an input part for inputting cutting information related to the cutting process of the sheet S, and as a display part. The reader 26 constitutes the input part.

The controller 45 includes the calculation part 451. The calculation part 451 functions as the guide controller 453. The controller 45 includes the guide controller 453. The guide controller 453 includes: a guide position setting part 4531 that sets the positions of the abutment guide 93 and the side guides 961 to 964 in the width direction based on the position on the sheet S where the sheet S is cut by the cutting part 19; and a switching controller 4532 that switches the mode between a first mode in which the setting of the guide position setting part is changed to a position where the upper ends of the side guides 961 to 964 support the lower side edges of the cut sheets Q discharged from the discharge port, and a second mode in which the setting of the guide position setting part is changed to a position where the side guides 961 to 964 do not come into contact with the cut sheets Q when the cut sheets Q stacked in the placement part 83 reaches a predetermined height. Specific examples of the first mode and the second mode will be described later.

The guide controller 453 may be configured to provide a control to adjust the set positions of the abutment guide 93 and the side guides 961 to 964 based on the position of the position mark M1 read by the reader 26. Furthermore, the guide controller 453 provides guide control allowing the side guides 961 to 964 to reciprocate a predetermined distance in the sheet conveyance width direction from the standby position for each predetermined number of sheets discharged, to thereby control the side guides 961 to 964 to perform jogger action to align the left and right edges of the cut sheets in the sheet conveyance width direction. The controller 45 controls the guide driver 52 to position the side guides 961 to 964 at a position where the sheet S discharged from the discharge port is supported from below by the side guides 961 to 964. When level sensors 201*a* and 201*b* detect that the sheets S stacked in the placement part 95 have reached a predetermined height, the controller 45 controls the guide driver 52 to move the side guides 961 to 964 to a position where the side guides 961 to 964 do not support the sheet S from below. When the level sensors 201*a* and 201*b* detect that the sheets S have reached a predetermined height continuously for a predetermined amount of time, the controller 45 controls the guide driver 52 to move the side guides 201*a* and 201*b* to a position where the side guides 201*a* and 201*b* do not support the sheet S from below. When supporting the sheet S from below, the controller 45 controls the guide driver 52 so that one side edge of the sheet S is supported by the first side guides 961 to 964 and that the second side guides 961 to 964 lie at a position apart a predetermined distance from the other side edge of the sheet. The controller 45 can control the guide driver 52 to perform jogger action to align the side edges of the sheets S, and the controller 45 moves the first side guides 961 to 964 from a position supporting one side edge of the sheet S to a position apart a predetermined distance from the one side edge of the sheet S before starting the execution of the jogger action. The controller 45 controls the abutment guide 93 to move to a retracted position apart a predetermined distance from the leading edges of the sheets S before starting the execution of the jogger action.

[Machining process pattern of Sheet S]

FIG. 2 is a plan view showing an example of a machining process pattern of a sheet S. The machining process pattern shown in the figure is for producing a plurality of cut sheets Q from one sheet S. Cutting lines T as a plurality of processing lines extending parallel to the conveyance direction F and cutting lines K as a plurality of processing lines extending in the width direction W orthogonal to the conveyance direction F are set.

First and sixth cutting lines T1 and T6 shown at the right and left ends in FIG. 2 are formed by a unit 20*a* disposed most upstream among the slitters 20 on the conveyance path 5 in FIG. 1. Second and fifth cutting lines T2 and T5 formed inside the first and sixth cutting lines T1 and T6, respectively, are formed by a central unit 20*b* in the conveyance direction F. Third and fourth cutting lines T3 and T4 formed further inside the second and fifth cutting lines T2 and T5, respectively, are formed by a unit 20*c* disposed most downstream in the conveyance direction F. The unnecessary strip-shaped cutting scraps Jb between the second cutting line T2 and the third cutting line T3 and between the fourth cutting line T4 and the fifth cutting line T5 are guided downward by the cutting-scrap removal mechanism 27 shown in FIG. 1 and collected in the cutting-scrap collection part 23.

Cutting lines K are formed by simultaneously performing the cutting work a plurality of times on a plurality of strip-shaped cut pieces juxtaposed in the width direction W, which are obtained by cutting the sheet S parallel to the conveyance direction F at the cutting lines T1 to T6 and removing the elongated cutting scraps J cut off from the sheet S.

In the machining process pattern of the sheet S shown in FIG. 2, since no fold lines are set by the creaser 21, in the machining processing part 24 illustrated in FIG. 1, the creaser 21 is prohibited from functioning while being received in a receptacle 6 so as not to perform the creasing process, or is replaced with a conveyance processing part not shown, or the creaser 21 is detached from the receptacle 6 for use in an empty state.

For such an arrangement pattern of the cut sheet Q, various pieces of processing information to be applied to the sheet S are set by a processing job created in advance. Alternatively, the user sets the various pieces of processing information using the operation panel 46. Alternatively, the various pieces of processing information are recorded in the barcode M2 on the sheet S. These various pieces of processing information includes: information about the sheet S itself, such as the length of the sheet S in specific directions such as the conveyance direction length and width direction length, thickness, type, etc.; information about the cut sheets Q, such as the arrangement, number, and dimensions of the cut sheets Q; and information about the processing of the sheet S, such as the size and number of unnecessary cutting scraps J to be cut off from the sheet S and information on the sorting process of the cut sheets Q. The information regarding the sorting process includes: sorting necessity information on whether to execute the sorting process in the sorter 2; sorting timing information on the timing to execute the sorting process; sorting distance information on the distance between successively sorted cut sheets Q in the placement part 83; sorting stacking information on the method of stacking the cut sheets Q to be sorted, such as the overlap length between the preceding cut sheet Q and the succeeding cut sheet Q; and sorting notification information on whether to alert with light or sound when sorting.

Once the setting of the processing information is complete, it can be stored in a storage device of the controller 45. By assigning a number, title of processing, name, etc. to each of plural groups of processing information different in e.g. the arrangement pattern of the cut sheets Q after the sheet S machining process and by storing them in the storage device, the user can operate the operation panel 46 as an operation part to call up the processing information related to the required processing content from the storage device to process the sheet S.

[Configuration of Sorter 2]

A specific configuration of the sorter 2 will then be described.

Figure 3:
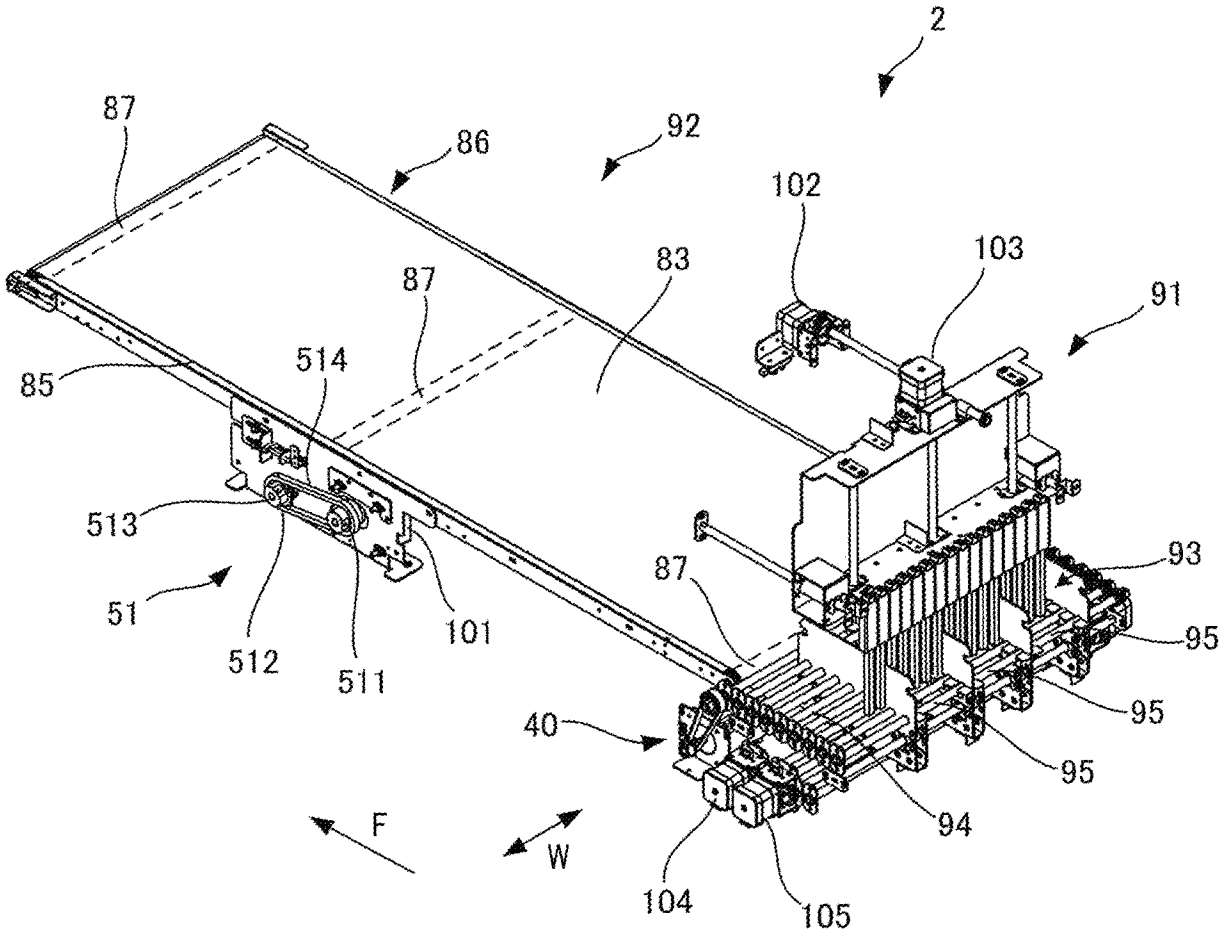
FIG. 3 is an overall perspective view of a sorter.

As shown in FIG. 3, the sorter 2 includes the stacking conveyor 91 and the stacker 92, which are driven independently of each other. The stacking conveyor 91 receives in the placement part 95 the processed cut sheets Q continuously discharged in one or more rows in the sheet advance direction from the main body 1 (machining processing part) of the machining processing device D; stacks the processed cut sheets Q in a sorting unit; and then continuously conveys each stack of the stacked sheets Q' after stacking downstream. The stacker 92 is disposed downstream of the stacking conveyor 91, and continuously stacks the stacked sheets Q' conveyed from the stacking conveyor 91 at different positions on the placement surface in a sorted manner. More specifically, the stacking conveyor 91 includes the plurality of rotating rollers 94 (drive rollers) over which the stacked sheets Q' are loaded for conveyance. The stacker 92 includes the placement part 83 where the stacked sheets Q' can be placed at different positions on the placement surface in a sorted manner. The placement part 83 includes the belt conveyor 86 having the circulating belt 85 on which the stacked sheets Q" are loaded. The stacked sheets Q' conveyed from the stacking conveyor 91 are placed on the belt conveyor 86 while being conveyed.

The conveyor driver 51, which is a drive mechanism for rotating the belt conveyor 86, will then be described. The belt conveyor 86 in the stacker 92 includes the endless belt 85, three conveyor rollers 87, and the conveyor driver 51. The conveyor rollers 87 are arranged at three locations spaced a predetermined distance from each other in the discharge direction of the stacked sheets Q', which is the same direction as the conveyance direction F of the sheet S. The belt 85 is stretched over and around the conveyor rollers 87. The conveyor driver 51 rotates the endless belt 85. The conveyor driver 51 is a drive mechanism for conveying the stacked sheets Q' after sorting process toward the downstream side in the conveyance direction F. The conveyor driver 51 includes a motor 101 that functions as a drive means, a pulley 511 attached to the rotating shaft of the motor 101, a pulley 512 attached to a rotating shaft 513 of the conveyor roller 87, and a timing belt 514 stretched between these pulleys 511 and 512. When the motor 101 is rotationally driven, the driving force is transmitted via the pulleys 511 and 512 to the rotating shaft 513 of the conveyor roller 87. As a result, the conveyor roller 87 rotates, causing the endless belt 85 to rotate.

The length of the belt 85 in the width direction W is a predetermined length that is substantially the same as the length in the width direction W of the conveyance path 5 along which the sheet S is conveyed, or is slightly longer than the length in the width direction W of the conveyance path 5. A plurality of processed cut sheets Q discharged in parallel in the width direction W can be loaded on the belt 85. The conveyor driver 51 is electrically connected to the controller 45, which controls the drive amount of the conveyor driver 51, to thereby adjust the belt conveyor 86 to run at a predetermined velocity.

Figure 4:
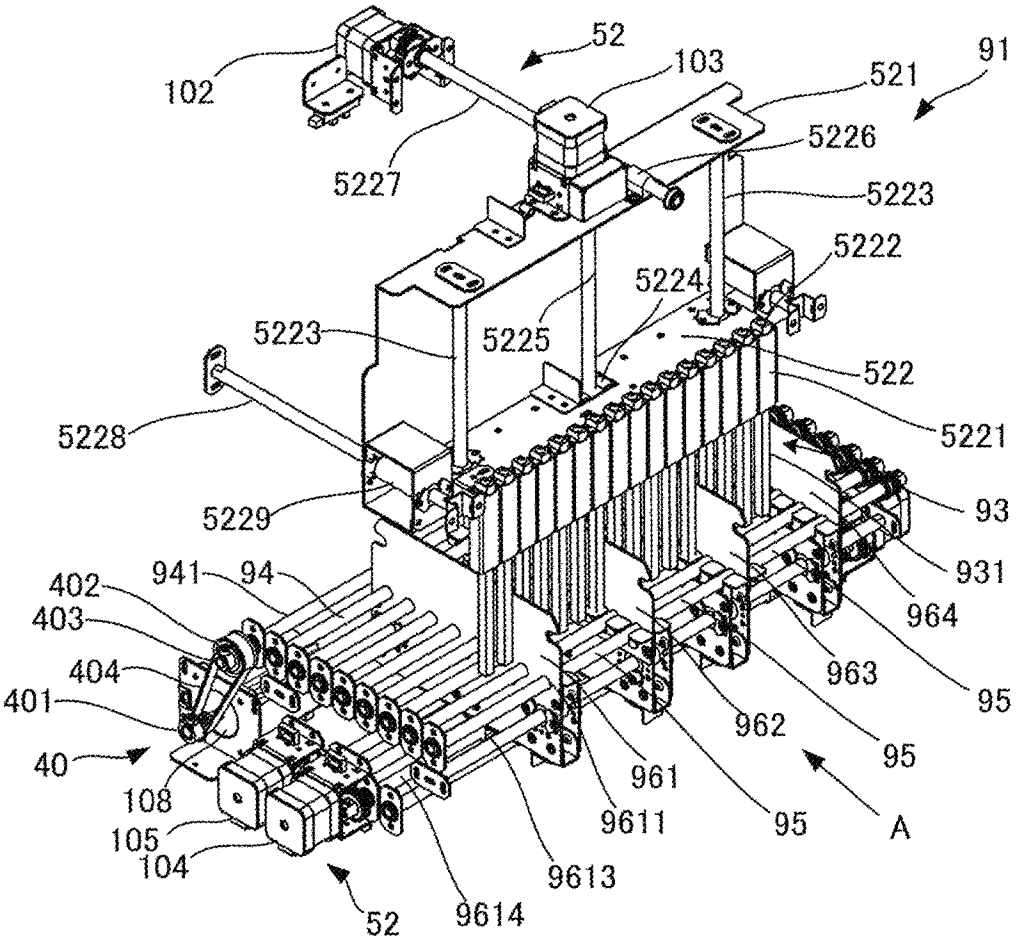
FIG. 4 is a perspective view of a stacking conveyor.

A configuration of the stacking conveyor 91 will then be described. As shown in FIG. 4, the stacking conveyor 91 includes the placement part 95 that receives the processed cut sheets Q continuously discharged in one or more rows in the sheet advance direction from the main body 1 (machining processing part), and the plurality of rollers 94 (drive rollers) as rollers that continuously convey the received cut sheets Q stacked in a sorting unit to the stacker 92. In this embodiment, the cut sheets Q are discharged in three rows from the main body 1 and stacked in three rows in a sorted manner.

This allows means for loading and conveying the stacked sheets Q' to be constructed simply and at low costs.

The placement part 95 includes: the abutment guide 93 that regulates the front ends of the cut sheets Q when the cut sheets Q are stacked; and side guides 961 to 964 that regulate the left and right edges in the sheet conveyance width direction of the cut sheets Q. In this embodiment, an example is shown where three rows of processed cut sheets Q as shown in FIG. 2 are discharged from the main body 1 and received by the placement part 95.

The abutment guide 93 and side guides 961 to 964 in the placement part 95 are driven by the guide driver 52. The plurality of rollers 94 are driven by the roller driver 40. The guide driver 52 and the roller driver 40 are electrically connected to the controller 45. The controller 45 controls the drive amount of the guide driver 52 to adjust the positions of the abutment guide 93 and the side guides 961 to 964. The guide driver 52 includes: a motor 103 for driving the abutment guide 93 in the up-down direction; a motor 102 for driving the abutment guide 93 in the front-rear direction in the conveyance direction F; and motors 104 to 106 for driving the side guides 961 to 964 in the left-right direction in the conveyance width direction. The roller driver 40 includes a motor 108 for driving and rotating the plurality of rollers 94. In this embodiment, the motor 101 is a DC gear motor, and the other motors 102 to 108 are stepping motors.

A drive mechanism will then be described that moves the abutment guide 93 in the up-down direction in the guide driver 52. A subframe 522 is configured to be slidable vertically relative to a mainframe 521 via guide shafts 5223 arranged at two locations in the conveyance width direction. A lead nut 5224 is fixed integrally to the subframe 522, with a lead screw 5225 being screwed into the lead nut 5224. The lead screw 5225 is secured integrally to the rotating shaft of the motor 103 fixed to the mainframe 521, and the subframe 522 is driven vertically by the lead nut 5224 screwed onto the lead screw 5225 when the motor 103 is rotated. As a result, the abutment guide 93 can be driven vertically.

Figure 5:
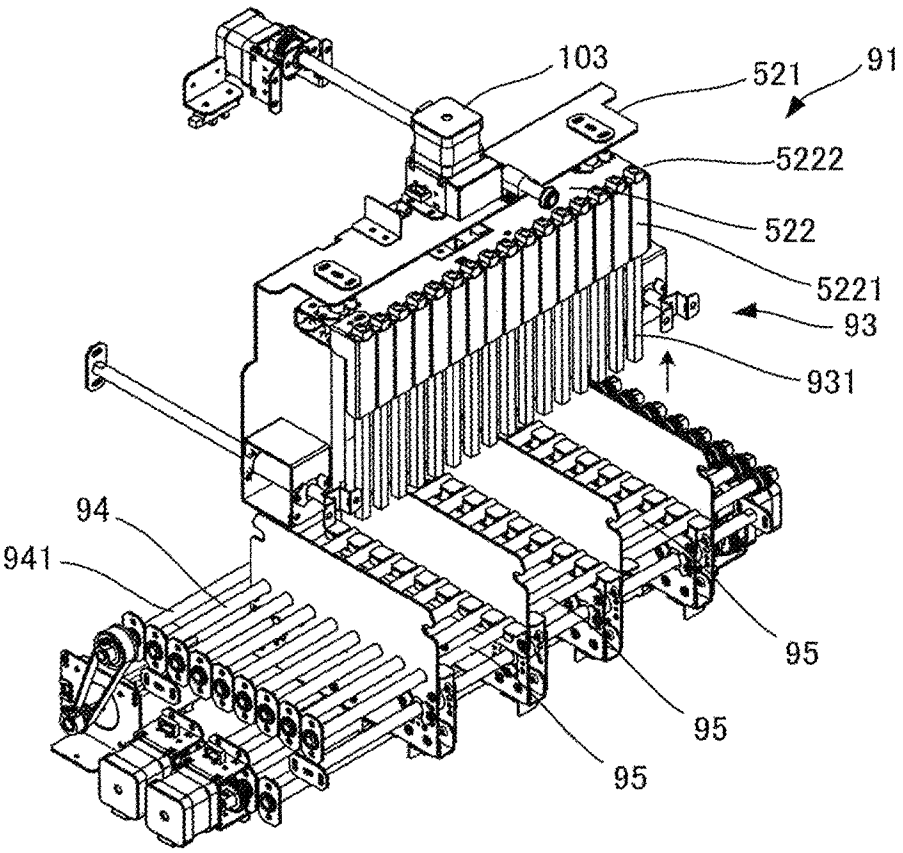
FIG. 5 is a perspective view of the stacking conveyor.

FIG. 4 shows a state in which the abutment guide 93 advances downward relative to the conveyance surface of the cut sheets Q when the cut sheets Q are stacked. FIG. 5 shows a state in which the abutment guide 93 retreats upward relative to the conveyance surface of the stacked sheets Q' when the stacked sheets Q' is conveyed downstream. This improves the performance of aligning in the conveyance direction F the cut sheets Q loaded on the sorter 2.

A drive mechanism for sliding the abutment guide 93 forward and backward in the conveyance direction F in the guide driver 52 will then be described. The mainframe 521 is disposed at two locations in the conveyance width direction of the mainframe 521, and is configured to be slidable forward and backward in the conveyance direction F via a guide shaft 5228 fitted into a linear bush 5229. A lead nut 5226 is fixed integrally to the mainframe 521, with a lead screw 5227 being screwed into the lead nut 5226. The lead screw 5227 is secured integrally to the rotating shaft of the motor 102. By rotationally driving the motor 102, the entire unit of the mainframe 521 and the subframe 522 is driven forward and backward by the lead nut 5226 screwed onto the lead screw 5227. As a result, the abutment guide 93 can be slid forward and backward in the conveyance direction F depending on the size of the cut sheets Q to be stacked. Although in FIGS. 3 to 6, the motor 102 and one end of the guide shaft 5228 are depicted as being in the air in the drawings, but in reality they are integrally fixed to an outer frame (not shown) that is arranged around the outside of the mainframe 521 and the subframe 522.

A description will then be given of the drive mechanisms for the left and right directions in the conveyance width direction of the side guides 961 to 964 in the guide driver 52. Since the drive mechanisms for the side guides 961 to 964 are all the same in configuration, only one of them, the side guide 961, will be described.

The plurality of side guides 961 to 964 are arranged to separate the cut sheets Q in one row or between plural rows in the placement part 95. This allows the cut sheets Q continuously discharged in one or more rows to be received and intactly stacked in the sorted state.

The side guide 961 has cutouts 9611 in its side wall through which the rollers each pass, and is configured so that the disposed position of the side guide 961 in the sheet conveyance width direction can be adjusted through the cutouts 9611. This eliminates problems such as paper slipping through the gaps between the side wall of the side guide 961 and the plurality of rollers 94 and improves the performance of aligning in the sheet conveyance width direction the cut sheets Q loaded on the sorter 2.

Between adjacent ones of the rollers 94, an auxiliary guide 9612 is disposed to fill in the gaps on the paper conveyance path.

This makes it possible to prevent jams from occurring on the paper conveyance path.

A lead nut 9613 is fixed integrally to the side guide 961, with a lead screw 9614 being screwed into the lead nut 9613. The lead screw 9614 is fixed integrally to the rotating shaft of the motor 104, and by rotationally driving the motor 104, the lead nut 9613 screwed onto the lead screw 9614 moves the side guide 961 leftward and rightward in the sheet conveyance width direction depending on the size of the cut sheets Q to be stacked. In the similar configuration, by rotationally driving the motor 105, the side guide 962 moves leftward and rightward in the sheet conveyance width direction, and by rotationally driving the motor 106, the side guide 963 moves leftward and rightward in the sheet conveyance width direction. By rotationally driving a motor 107, the side guide 964 moves leftward and rightward in the sheet conveyance width direction.

When the side guide 961 moves leftward and rightward in the sheet conveyance width direction depending on the size of the cut sheets Q, it moves with the abutment guide 93 being retracted upward relative to the conveyance path. After the position adjustment of the side guide 961, any of a plurality of guide members 931 may hit against the upper end of the side guide 961 as the abutment guide 93 advances downward relative to the conveyance path, but since each guide member 931 is configured to be able to move vertically and transversely under its own weight up to the regulation position of the stopper, the guide member 931 hitting against the upper end of the side guide 961 can be lifted upward and retreated. Alternatively, the guide member 931 hitting against the upper end of the side guide 961 may also avoid the upper end of the side guide 961 by shifting transversely by the amount of the clearance between the guide member 931 and a guide folder 5221.

Figure 6:
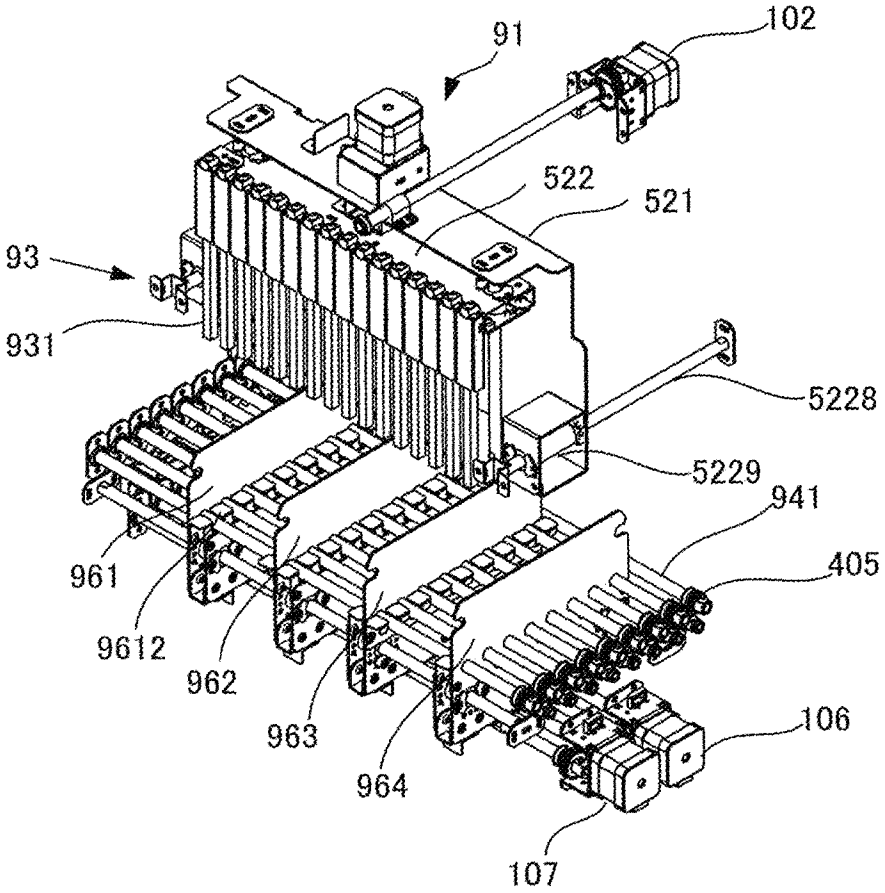
FIG. 6 is a perspective view of a stacking conveyor.

A rotation drive mechanism for the rollers 94 in the roller driver 40 will then be described. The roller driver 40 is a drive mechanism for rotating the rollers 94 to convey the stacked sheets Q' after sorting process downstream in the conveyance direction F. The roller driver 40 includes the drive motor 108 functioning as a drive means, a pulley 401 attached to the rotation shaft of the drive motor 108, a pulley 402 attached to a rotation shaft 403 of a roller 941, and a timing belt 404 stretched between the pulleys 401 and 402. When the drive motor 108 is rotationally driven, the drive force is transmitted to the rotation shaft 403 of the roller 941 via the pulleys 401 and 402, causing the roller 941 to rotate. As shown in FIG. 6, a gear 405 is attached to the side of roller 941 facing the drive motor 108, and gears 405 are also attached to the same side of the other rollers 94, the gears 405 meshing with each other in sequence to transmit the rotation drive from the roller 941 to all of the other rollers 94 in sequence.

[Guide Position Control]

Guide position control will then be described. As described above, the abutment guide 93 and side guides 961 to 964 in the placement part 95 are driven by the guide driver 52. The guide driver 52 is electrically connected to the controller 45, and the guide controller 453 in the controller 45 controls the drive amount of the guide driver 52 to control the position of each guide. The guide driver 52 includes the motors 102 to 107 for driving the abutment guide 93 forward and backward in the conveyance direction and the side guides 961 to 964 leftward and rightward in the conveyance width direction so that it can drive the abutment guide 93 and the side guides 961 to 964 independently of each other.

The guide controller 453 includes the guide position setting part 4531 that sets the position in the conveyance direction of the abutment guide 93 and the positions in the width direction of the side guides 961 to 964 based on the position of sheet cutting by the cutting part 19. Specifically, the machining processing device executes a processing job in which processing conditions for the sheet having deliverables printed thereon are set in accordance with processing data created in advance. The processing job includes information such as the processing mode, cutting position, and guide position.

The guide controller 453 may be configured to adjust the processing mode setting, the cutting position, and the positions of the abutment guide 93 and the side guides 961 to 964 based on the information of the barcode M2 read by the reader 26. The user may adjust the processing mode setting, the cutting position, and the positions of the abutment guide 93 and the side guides 961 to 964 by operating the operation panel 46 as an operation unit.

The guide controller 453 further includes a switching controller 4532 for switching the mode between a first mode in which the guide position setting part 4531 sets the setting to a position where the upper ends of the side guides 961 to 964 support the lower side edges of the cut sheet Q discharged from the discharge port, and a second mode in which the positions of the side guides 961 to 964 are changed to positions where they do not come into contact with the cut sheet Q when the cut sheets Q stacked in the placement part 83 reaches a predetermined height.

(1) First Mode

Figure 11:
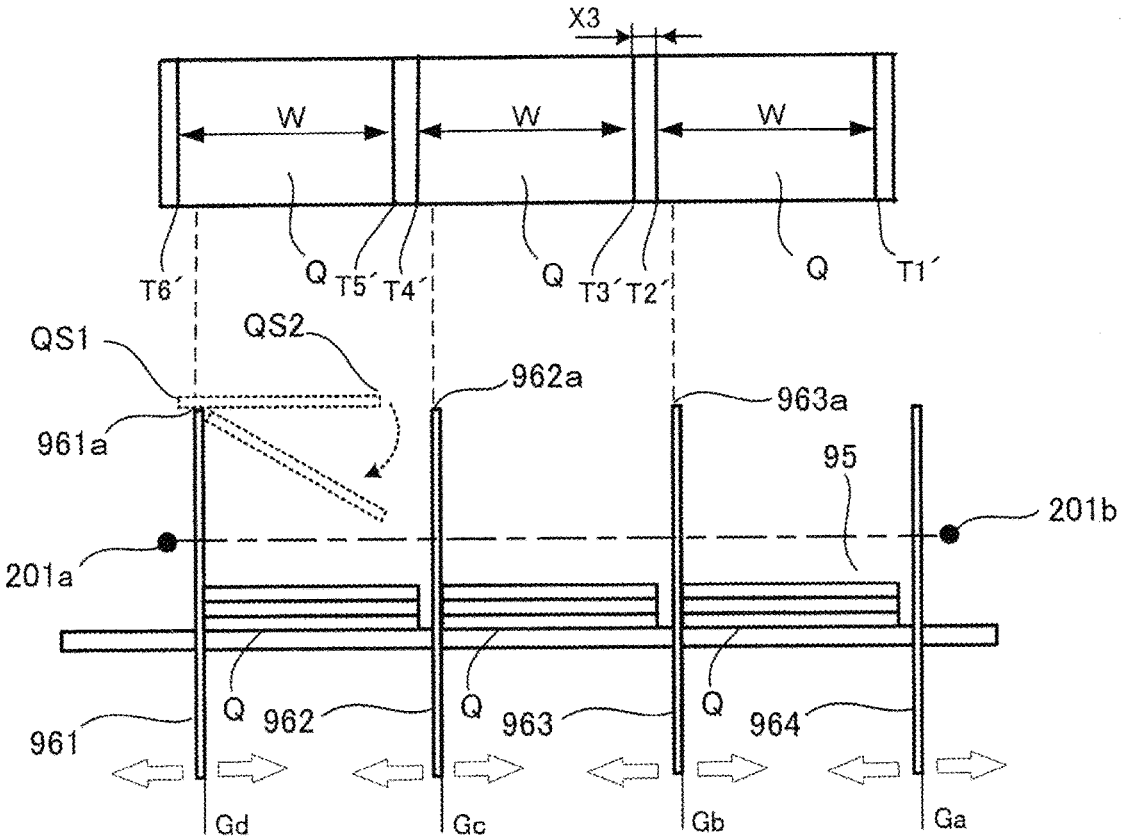
FIG. 11 is a diagram showing the positional relationship between the cutting position and side guides in a first mode.

FIG. 11 is a diagram showing the relationship between cutting positions T1' to T6' and the side guides 961 to 964 when the processing contents of FIG. 2 are used. Positions Ga, Gb, Gc, and Gd are set that correspond to the positions T1' to T6' obtained by the processing job created in advance. Then, the guide controller 453 controls the guide driver 52 to allow the side guides 961, 962, 963, and 964 to move to the positions Ga, Gb, Gc, and Gd, respectively.

As shown in FIG. 11, in the first mode, the guide controller 453 sets the positions of the side guides 961 to 964 so that, when the processed cut sheets Q are discharged, the cut sheet Q is supported at one side edge portion QS1 from the underside of the side edge portion QS1 by one of the side guides 961 to 963 and slides along the upper ends 961*a* to 963*a* of the side guides 961 to 963, allowing the cut sheet Q to fall under its own weight from the other side edge portion QS2 of the cut sheet Q toward the placement surface of the placement part 95.

This makes it possible to improve the performance of aligning the sheets stacked in the placement part 95 irrespective of the type of sheet discharged from the discharge port, and makes it possible to set the guide position simply and reliably.

The side guides 961 to 964 include a first side guide and a second side guide arranged adjacent to each other in the width direction. In the first mode, the first side guide lies at a position in contact with one side edge of the cut sheet Q, and the second side guide lies at a position a predetermined distance apart from the other side edge of the cut sheet Q.

As a result, even if the length of the cut sheet Q in the conveyance direction is short and the nip distance of the sheet discharged from the discharge port by the discharge rollers is insufficient, one side edge QS1 of the cut sheet Q is supported from below by one of the side guides 961 to 963, so that the cut sheets are not piled up disorderly near the discharge port before fully reaching the placement part 95, thus achieving stable and uniform stacking. Similarly, even if the paper is thin, one side edge QS1 of the cut sheet Q is supported from below by one of the side guides 961 to 963, so that the cut sheets are stacked up in the placement part 95 without wrinkling. In addition, the performance of aligning the sheets stacked in the placement part 95 can be improved.

Figure 10A:
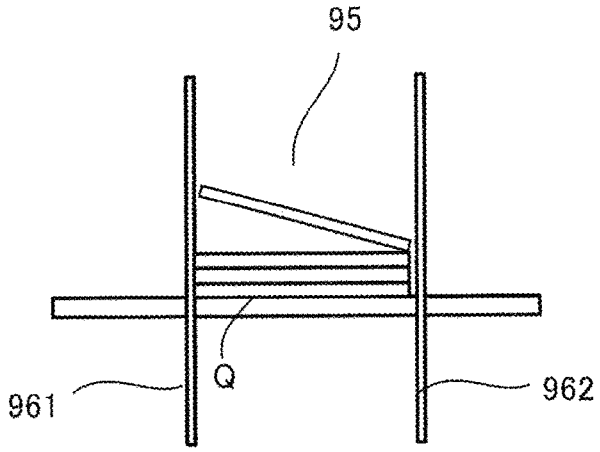
FIGS. 10A and 10B are diagrams each showing a state where sheets are stacked in a placement part.

In this case, as shown in FIG. 10A, for example, if the distance between the side guides 961 and 962 is too narrow, one side of the cut sheet Q may get caught on the side guide 961, which may hinder the cut sheets Q from being stacked normally. In the present disclosure, however, the positions of side guides 961 to 964 are not adjusted manually, but are automatically adjusted depending on the type of sheet, causing no problem.

(2) Second Mode

Figure 10B:
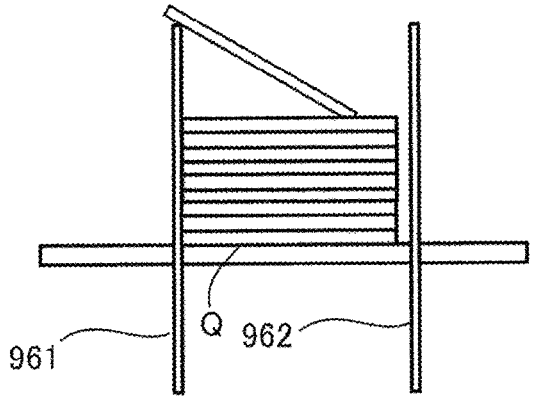

As shown in FIG. 10B, if the one-sided contact mode continues, the cut sheets Q may stack up and one side of the cut sheet Q may get caught on the side guide 961, which may hinder the cut sheets Q from being stacked normally.

Figure 12:
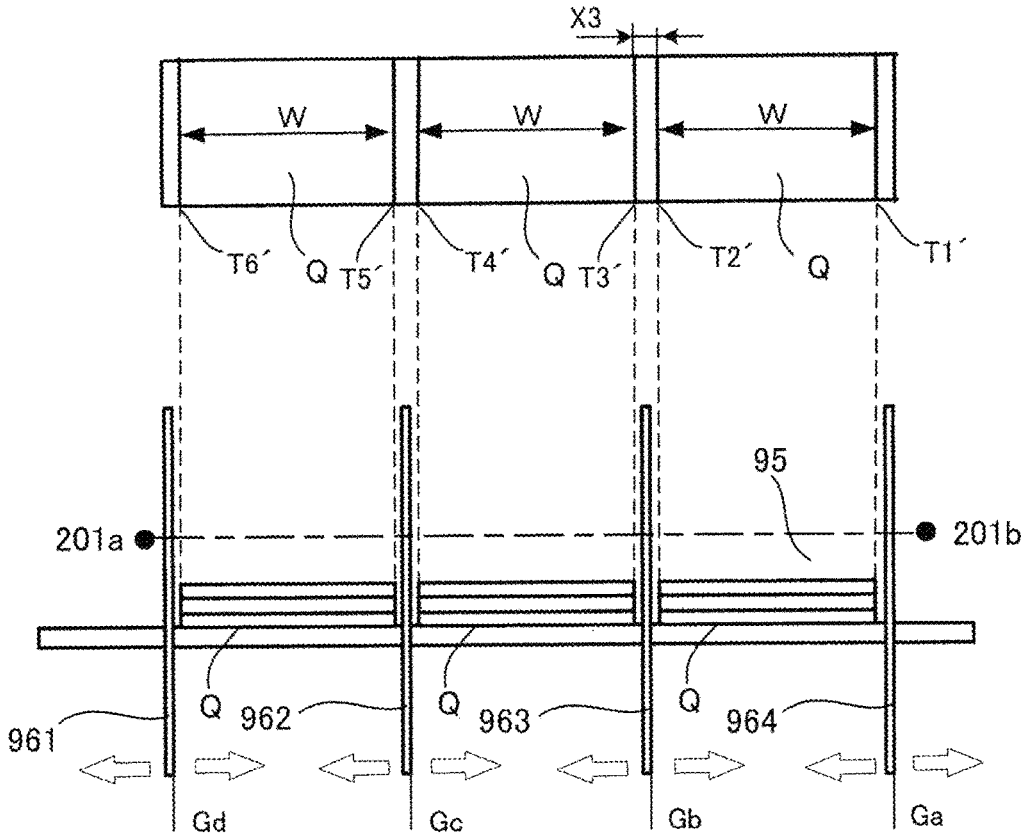
FIG. 12 is a diagram showing the positional relationship between the cutting position and the side guides in a second mode.

FIG. 12 is a diagram showing the relationship between the cutting positions T1' to T6' and the side guides 961 to 964 when the processing contents of FIG. 2 are used. The positions Ga, Gb, Gc, and Gd are set that correspond to the positions T1' to T6' obtained by the processing job created in advance. Then, the guide controller 453 controls the guide driver 52 to allow the side guides 961, 962, 963, and 964 to move to positions Ga, Gb, Gc, and Gd, respectively.

The above problem is solved, for example, by the switching controller 4532 switching the mode to the second mode in which the positions of the side guides 961 to 964 are changed to the positions not coming into contact with the stack end faces of the cut sheets Q when the disposed optical level sensors 201*a* and 201*b* detect that the cut sheets Q stacked in the placement part 95 have reached a predetermined height. In the second mode, compared to the first mode, there are gaps on both sides between the stack end faces and the side guides 961 to 964, making it possible to effectively prevent one side of the cut sheets Q from getting caught on the side guide 961.

Thus, irrespective of the number of sheets stacked in the placement part 95, the performance of aligning the sheets stacked in the placement part 95 can be improved.

The switching control part 9532 is configured to switch the mode to the second mode when the level sensors 201*a* and 201*b* detect, continuously for a predetermined amount, that the sheets have reached a predetermined height. The predetermined amount is the stack amount, the number of discharged sheets, time, etc.

This can prevent erroneous detection by the level sensors 201*a* and 201*b*.

The first mode and the second mode may be configured to be optionally selectable by the user.

This allows the user to flexibly set the mode depending on the type of sheet and the sheet stacking situation.

[Jogger Action]

The jogger action will next be described. As described above, the guide controller 453 performs the guide control that controls the guide driver 52 to reciprocate the side guides 961 to 964 a predetermined distance in the sheet conveyance width direction from the standby position for each predetermined number of sheets discharged, to thereby provide a control allowing the execution of the jogger action for aligning the left and right edges of the cut sheets Q in the sheet conveyance width direction.

The guide controller 453 is configured to execute the jogger action to align the side edges of the cut sheets Q. Prior to switching from the first mode to the second mode, the guide controller 453 allows the first side guide to move from a position coming into contact with one side edges of the cut sheets Q to a position a predetermined distance apart from the side edges of the sheets, to thereafter perform the jogger action. A specific example will be described later.

This can further improve the performance of aligning the sheets stacked in the placement part 95.

If the level sensors 201*a* and 201*b* do not detect that the cut sheets Q have reached a predetermined height after the execution of the jogger action, the mode is switched back to the first mode.

This makes it possible to prevent erroneous detection by the level sensors 201*a* and 201*b* due to the sheet getting caught.

The placement part 95 includes the abutment guide 93 that regulates the front ends of the cut sheets Q and whose position in the conveyance direction F can be changed by the guide controller 453. Before performing the jogger action, the abutment guide 93 is positioned at a retracted position a predetermined distance apart from the leading edges of the cut sheets Q stacked in the placement part 95.

This can further improve the performance of aligning the sheets stacked in the placement part 95, including the leading edges of the sheets.

Specific Example of Jogger Action

A specific example of the jogger action with three rows of cut sheets Q stacked in the placement part 95 will next be described with reference to FIGS. 13A to 13C and FIGS. 14D and 14E.

Figure 13A:
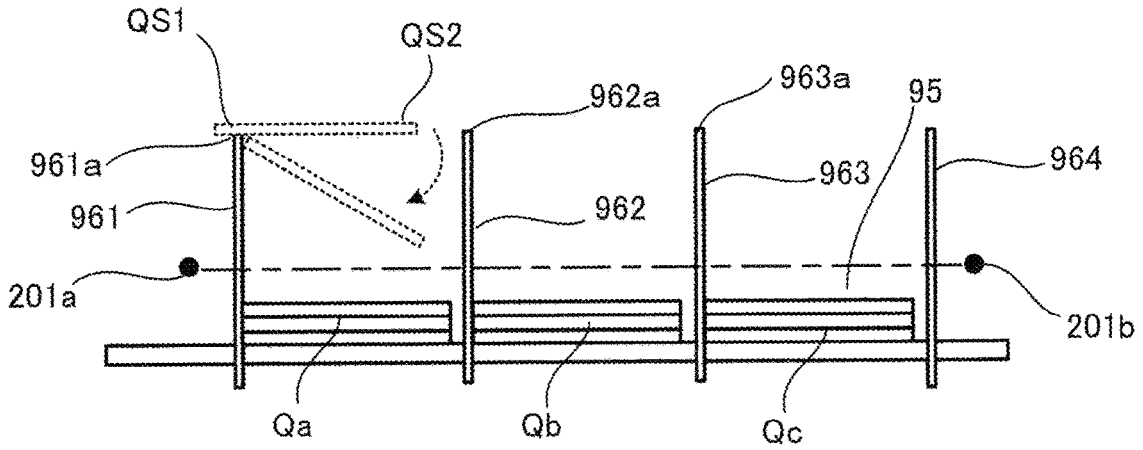
FIGS. 13A to 13C are diagrammatic views each showing a status of jogger action.

(1) As shown in FIG. 13A, the first mode is executed in which the positions of the side guides 961 to 963 are set to positions where their respective upper ends support the lower side edges of the cut sheets Q discharged from the discharge port, based on the positions of the side edges of the cut sheets Q discharged from the discharge port, and the cut sheets Q are stacked in the placement part 95.

Figure 13B:
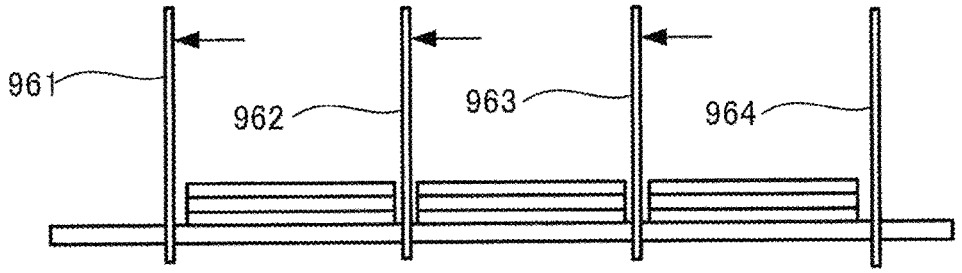

(2) Next, as shown in FIG. 13B, prior to switching from the first mode to the second mode, before the jogger action is executed, the first side guide 961 is moved from the position in contact with one side edges of the cut sheets Q to the position a predetermined distance apart from the side edges of the cut sheets Q.

Figure 13C:
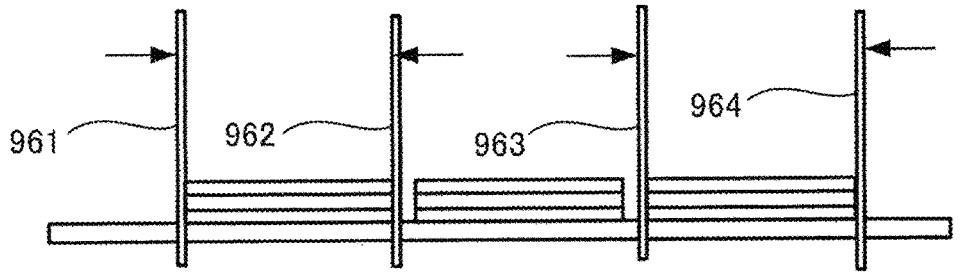

(3) Next, as shown in FIG. 13C, first, the side guides 961 and 962 in a pair and the side guides 963 and 964 in a pair are selected and then each pair is closed in the directions of arrows so that their inner surfaces abut against the left and right edges of cut sheets Qa and Qc.

Figure 14D:
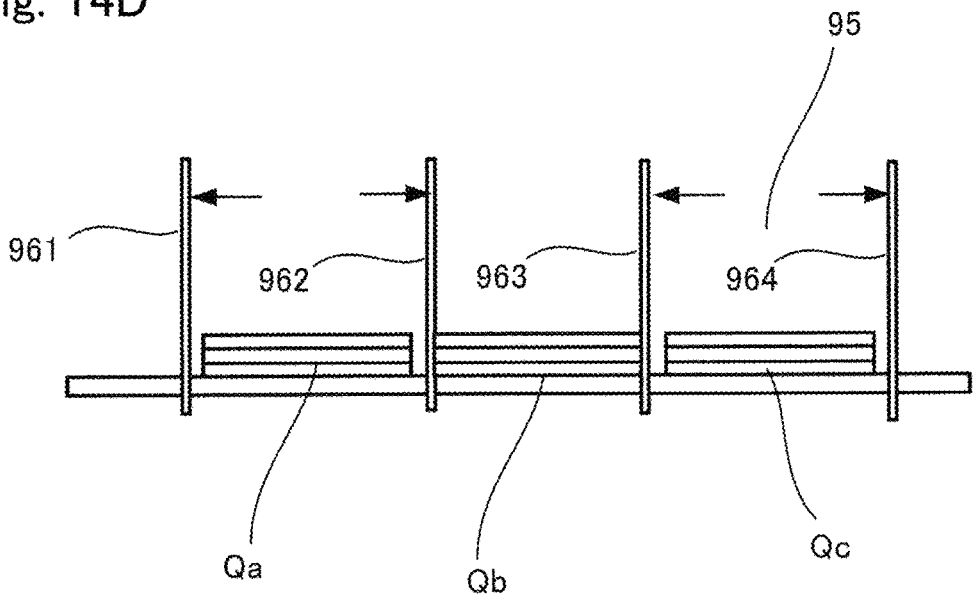
FIGS. 14D and 14E are diagrammatic views each showing a status of the jogger action.

(4) Next, as shown in FIG. 14D, the side guides 962 and 963 are selected in a pair and advanced toward each other in the directions of the arrows so that their respective inner surfaces abut against the left and right edges, respectively, of the cut sheets Qb. Note that the side guides 961 and 964 move away from each other in the directions of the arrows.

Figure 14E:
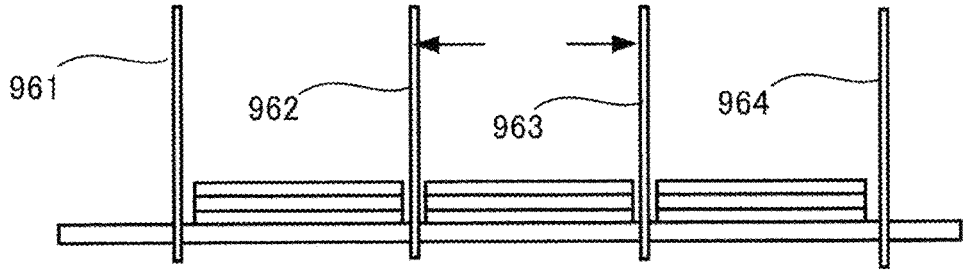

(5) Next, as shown in FIG. 14E, the side guides 962 and 963 are selected in a pair and moved in the directions of the arrows to positions where their respective inner surfaces are a predetermined distance away from the left and right edges, respectively, of the cut sheets Qb. From this point on, the operation continues in the second mode, and the cut sheets Q are stacked in the placement part 95. At this time, if the level sensors 201*a* and 201*b* have not detected the cut sheets Q, the operation may be configured to switch back to the first mode.

This ensures that the jogger action can reliably be executed on all of the targeted cut sheets, thus improving the alignment of the cut sheets in the placement part.

[Sorting Action of Sorter 2]

The sorting action of the sorter 2 will next be described.

When using the machining processing device D, the user enters various pieces of processing information, for example, from the operation panel 46 shown in FIG. 1. When executing the same processing contents as that already registered and stored in the storage device, the user operates the operation panel 46 as an operation part to enter a number, title of processing, name, etc., to call up necessary processing information from the storage device. The user then enters the number of sheets S to be processed and the number of processed cut sheets Q for sorting (sorting unit) through the operation panel 46, and then performs an operation to start processing.

At this time, the setting positions of the abutment guide 93 and the side guides 961 to 964 are automatically adjusted in advance depending on the size of the processed cut sheet Q among the entered pieces of processing information. The abutment guide 93 regulates the front ends of the processed cut sheets Q discharged in the conveyance direction F from the main body 1 (machining processing part), so that the cut sheets Q are stacked in the placement part 95 with their leading edges aligned. The side guides 961 to 964 can align the left and right edges in the width direction W orthogonal to the conveyance direction F. At this time, the abutment guide 93 is set so as to advance downward with respect to the conveyance path. The abutment guide 93 and the side guides 961 to 964 may also be configured to be capable of jogger action.

When the user performs the operation to start processing, the sheets S loaded in the feeder 3 of the machining processing device D are fed to the conveyance path 5 of the main body 1, and a predetermined machining process is performed at a predetermined position on the conveyed sheet S in the machining processing part 24. The processed cut sheets Q are discharged from the main body 1 toward the sorter 2.

The sorter 2 includes the stacking conveyor 91 and the stacker 92, and the processed cut sheets Q discharged from the main body 1 are first received by the placement part 95 of the stacking conveyor 91, stacked in a sorting unit, and then continuously conveyed to the stacker 92 lying downstream for each stack of the stacked sheets Q'. In this embodiment, the stacking conveyor 91 includes the plurality of rotating rollers 94 on which the stacked sheets Q' are loaded. The stacking conveyor 91 may be configured to include the belt conveyor 88 having the circulating belt on which the stacked sheets Q' are loaded, instead of the plurality of rollers 94.

The stacker 92 continuously stacks the stacked sheets Q' conveyed from the stacking conveyor 91 at different positions on the placement surface 83. The controller 45 provides control so that a predetermined gap is formed between the preceding stacked sheets Q' and the succeeding stacked sheets Q' among stacks of the stacked sheets Q' conveyed to the stacker 92 by the stacking conveyor 91. The stacker part includes the belt conveyor 86 having the circulating belt on which the stacked sheets Q' are loaded.

The stacking conveyor 91 is capable of placing plural stacks of stacked sheets Q' in the conveyance direction, and the controller 45 provides, in the stacking conveyor 91, control at least so as to receive the cut sheets Q in a conveyance stop state when stacking the cut sheets Q, stacks them in a sorting unit, and then accumulates stacks of stacked sheets Q' stepwise in sequence while shifting and conveying the sheets with midway stagnancy, and delivers the stacked sheets Q' stepwise in sequence from the accumulated stacks of stacked sheets Q' to the stacker 92.

According to the above, the sorting efficiency can be improved.

A specific example of the sorting action of the sorter 2 will next be described. FIGS. 7A to 7D and FIGS. 8E to 8H are diagrammatic views each showing a status of the sorting action of the sorter 2. Note that the side guides 961 to 964 are not shown in FIGS. 7A to 7D and FIGS. 8E to 8H.

The sorting action of the sorter 2 in this embodiment has been described as a series of sorting actions executed when the sheet S having the machining process pattern shown in FIG. 2 is discharged from the main body 1 in the form of processed cut sheets Q.

Figure 7A:
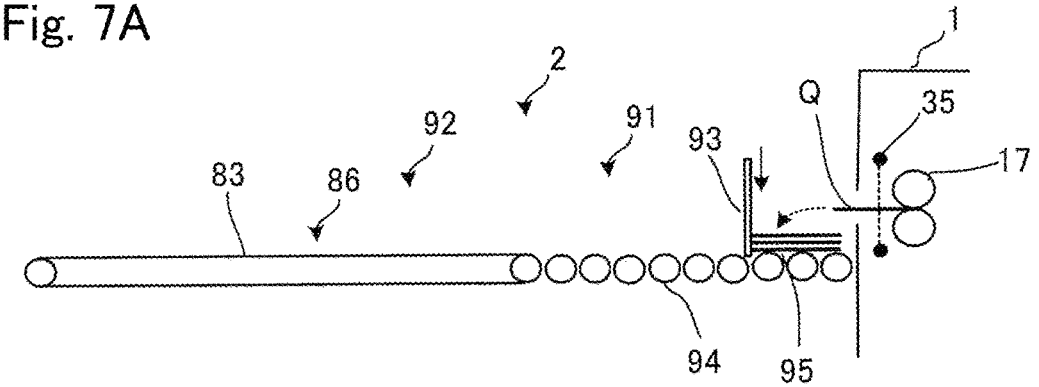
FIGS. 7A to 7D are diagrammatic views showing a status of sorting action of the sorter.

(1) As shown in FIG. 7A, the processed cut sheets Q are continuously discharged from the roller pair 17 of the main body 1 toward the placement part 95 of the stacking conveyor 91 and are stacked aligned by the abutment guide 93 and the side guides 961 to 964. The number of the cut sheets Q discharged from the main body 1 is counted by the fifth sensor 35.

Figure 7B:
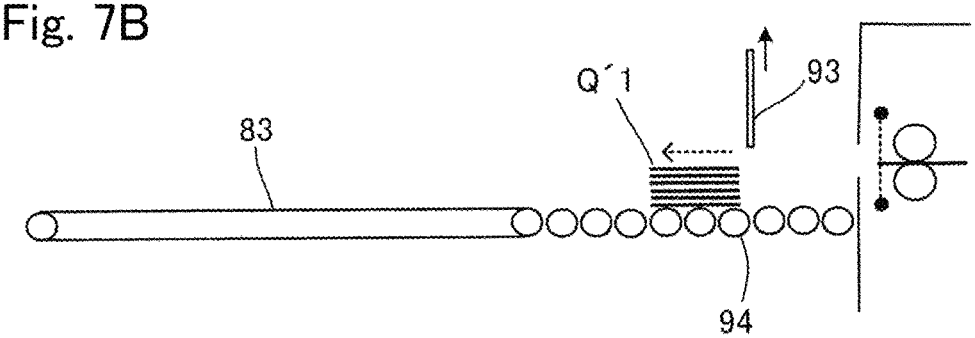

(2) Next, after the number of cut sheets Q stacked in the placement part 95 reaches the number of sheets for sorting (sorting unit), as shown in FIG. 7B, the abutment guide 93 is retracted upward, and then the roller driver 40 rotationally drives the plurality of rollers 94 to convey the stacked sheets Q'1 downstream a predetermined distance (roughly the length of the cut sheet Q in the conveyance direction plus the thickness of the abutment guide 93), to stop the rotation. At this time, the discharge of the cut sheets Q from the roller pair 17 of the main body 1 is stopped.

Figure 7C:
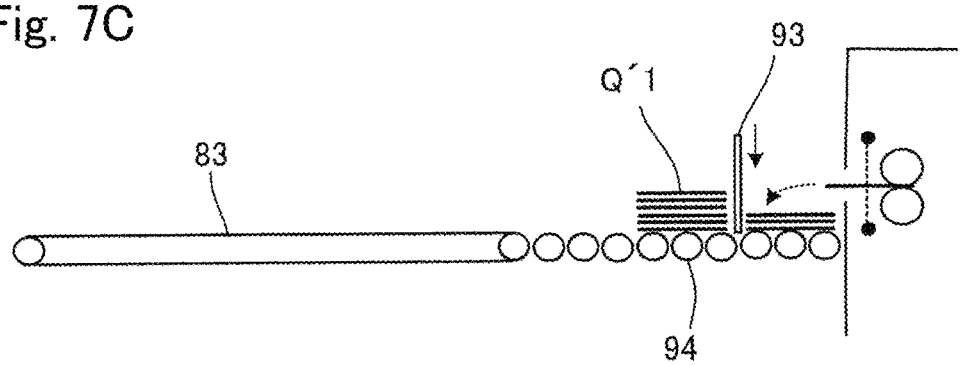

(3) Next, as shown in FIG. 7C, after the abutment guide 93 again advances downward relative to the conveyance path, the discharge of the cut sheets Q from the roller pair 17 of the main body 1 is resumed.

Figure 7D:
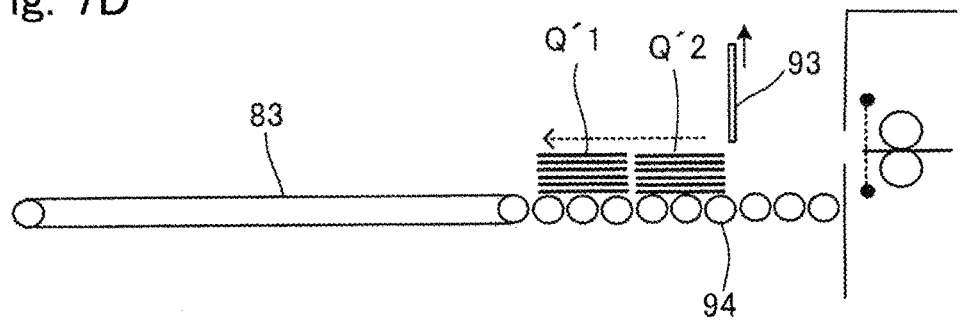

(4) Next, after the number of cut sheets Q stacked in the placement part 95 reaches the number of sheets for sorting (sorting unit), as shown in FIG. 7D, the abutment guide 93 is withdrawn upward, and then the roller driver 40 rotationally drives the rollers 94 to convey the stacked sheets Q'1 and Q'2 downstream by a predetermined distance, to stop the rotation. At this time, the discharge of the cut sheets Q from the roller pair 17 of the main body 1 is stopped.

Figure 8E:
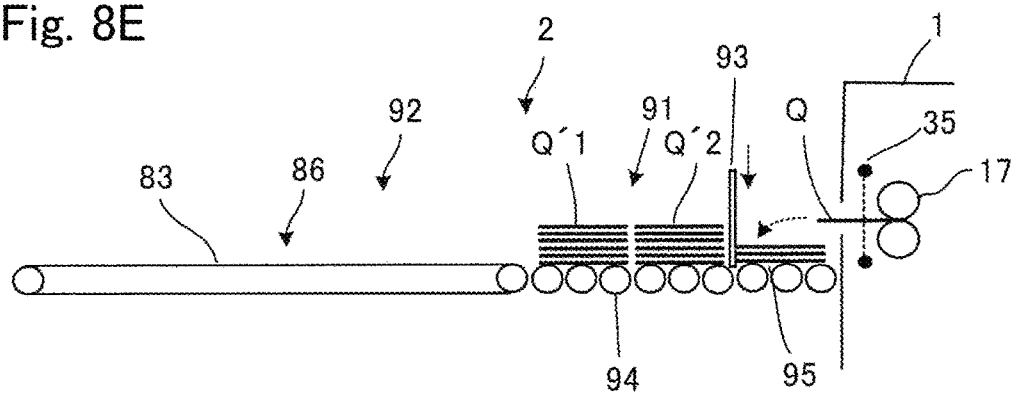
FIGS. 8E to 8H are diagrammatic views each showing a status of sorting action of the sorter.

(5) Next, as shown in FIG. 8E, after the abutment guide 93 has again advanced downward relative to the conveyance path, the ejection of cut sheets Q from the roller pair 17 of the main body 1 is resumed.

Figure 8F:
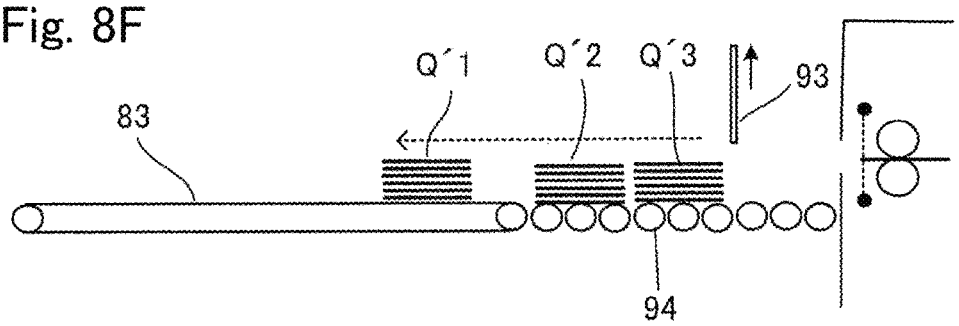

(6) Next, after the number of cut sheets Q stacked in the placement part 95 reaches the number of sheets for sorting (sorting unit), as shown in FIG. 8F, the abutment guide 93 is retracted upward, and then the roller driver 40 rotationally drives the rollers 94 to convey the stacked sheets Q'1, Q'2, and Q'3 downstream by a predetermined distance, and the rotation is stopped. At this time, only Q'1 is delivered from the stacking conveyor 91 to the placement part 83 (belt conveyor 86) of the stacker 92. The conveyor driver 51 rotationally drives the belt conveyor 86 when conveying the stacked sheets Q'1, Q'2, and Q'3 and stops the belt conveyor 86 after delivering the stacked sheets Q'1 from the stacking conveyor 91 to the stacker 92. At this time, the discharge of the cut sheets Q from the rollers 17 of the main body 1 is stopped.

Figure 8G:
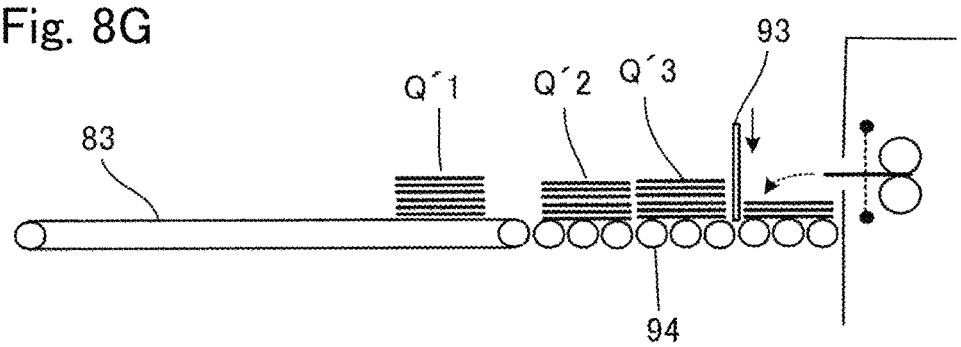

(7) Next, as shown in FIG. 8G, after the abutment guide 93 has again advanced downward relative to the conveyance path, the discharge of the cut sheets Q from the rollers 17 of the main body 1 is resumed.

Figure 8H:
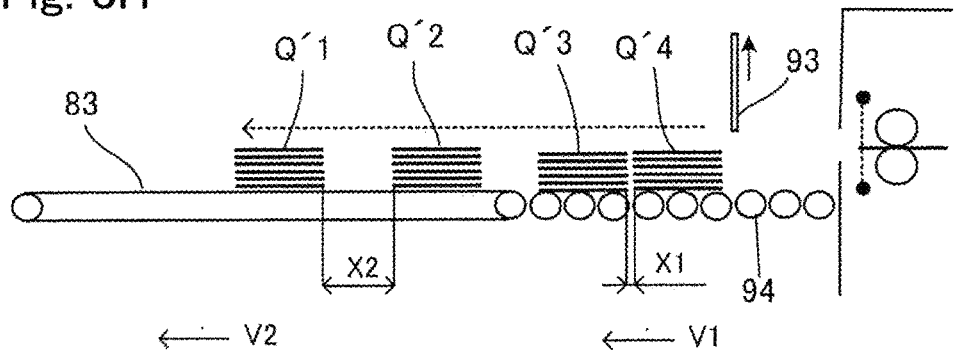

(8) Next, after the number of cut sheets Q stacked in the placement part 95 reaches the number of sheets for sorting (sorting unit), as shown in FIG. 8H, the abutment guide 93 is retracted upward, and then the roller driver 40 rotationally drives the rollers 94 to convey the stacked sheets Q'2, Q'3, and Q'4 downstream by a predetermined distance, to stop the rotation. At this time, only Q'2 is delivered from the stacking conveyor 91 to the placement part 83 (belt conveyor 86) of the stacker 92. The conveyor driver 51 rotationally drives the belt conveyor 86 when conveying the stacked sheets Q'2, Q'3, and Q'4 and stops the belt conveyor 86 after delivering the stacked sheets Q'2 from the stacking conveyor 91 to the stacker 92. At this time, the discharge of the cut sheets Q from the roller pair 17 of the main body 1 is stopped.

The stacking conveyor 91 and the stacker 92 are configured to be driven independently of each other, and a gap X1 between the stacked sheets Q' on the stacking conveyor 91 and a gap X2 between the stacked sheets Q' on the stacker 92 are separately controlled by the roller driver 40 and the conveyor driver 51, respectively, via the controller 45. X1 is roughly a gap that is the thickness of the abutment guide 93 plus a margin for the abutment guide 93 to move smoothly forward and backward, and may be a gap of approx. 10 mm. X2 is a gap necessary for an operator to easily remove the stacked cut sheets on the belt conveyor, and may be a gap of approx. 20 mm to 50 mm as a mere guideline. The relationship between the both is $X1<X2$, and the conveyance velocities V1 and V2 of the stacked sheets Q' on the stacking conveyor 91 and the stacker 92, respectively, are also in a relationship $V1<V2$. That is, when the stacked sheets Q' are delivered (conveyed while being shifted) from the stacking conveyor 91 to the stacker 92, control is provided such that the conveyance velocity is accelerated to widen the gap from X1 to X2. In the embodiment, the number of stacks of stacked sheets Q' lined up on the stacking conveyor 91 is described as three, but this is not limitative and it may be one or three or more. Also, the number of stacks of stacked sheets Q' lined up on the stacker 92 is described as two, but this is not limitative and it may be one or two or more.

According to the above, as long as the minimum gap X1 is secured between the stacks of stacked sheets Q' on the stacking conveyor 91, control to widen the gap up to the gap X2 allowing easy removal of the stacked sheets Q' is automatically performed, independently of the stacking conveyor 91, merely by delivering the stacked sheets Q' through shift convey, whereupon the stop time of the stacking conveyor 91 can be minimized, ensuring good operation efficiency. In the prior art, the cut sheets Q to be discharged are stacked up in predetermined numbers on one (one drive) belt conveyor and conveyed downstream with a predetermined gap, with the result that until the predetermined gap is secured downstream, the stacking operation (discharge operation) of the succeeding discharge sheets need be stopped while the preceding sheets are being conveyed (while the belt conveyor is running), which is inefficient.

By combining the sorter 2 with the machining processing device 1, the efficiency of the sorting operation can be improved, and the performance of aligning the cut sheets Q loaded on the sorter 2 in the conveyance direction F can be improved. Furthermore, the sorter 2 may be combined with other paper processing devices that perform sorting processes for printed matter, cards, mail, signatures, etc., or may be disposed halfway through a general paper conveying device.

It is apparent that the present disclosure is not limited to the above embodiments and that the embodiments may be modified as appropriate within the scope of the technical idea, other than suggested in the above embodiments. Furthermore, the number, position, shape, etc. of the constituent members are not limited to the present embodiments, and may be modified to any number, position, shape, etc. suitable for implementation.

What is claimed is:

1. A stacker comprising:

a placement part that stacks thereon sheets discharged from a discharge port by a conveyor that conveys the sheets;

a side guide that regulates edges of the sheets in a width direction intersecting a discharge direction of the sheets;

a guide driver that moves the side guide along the width direction;

a controller configured to control the guide driver to position the side guide at a position where the sheet discharged from the discharge port is supported from below by the side guide; and a level sensor, wherein when the level sensor detects that the sheets stacked in the placement part have reached a predetermined height, the controller controls the guide driver to move the side guide to a position where the side guide does not support the sheet from below.

2. The stacker according to claim 1, wherein when the level sensor detects, continuously a predetermined amount, that the sheets have reached the predetermined height, the controller controls the guide driver to move the side guide to the position where the side guide does not support the sheet from below.

3. The stacker according to claim 1, wherein the side guide comprises a first side guide and a second side guide arranged adjacent to each other in the width direction, and the controller controls the guide driver, when supporting the sheet from below, so that one side edge of the sheet is supported by the first side guide and that the second side guide lies at a position a predetermined length apart from the other side edge of the sheet.

4. The stacker according to claim 3, wherein the controller is configured to control the guide driver to execute jogger action to align the side edges of the sheets, and prior to starting the jogger action, the controller controls the guide driver to move the first side guide from a position supporting one side edge of the sheet to a position a predetermined length apart from the one side edge of the sheet.

5. The stacker according to claim 4, comprising an abutment guide disposed in the placement part, for regulating leading edges of the sheets, wherein prior to starting the jogger action, the controller controls the guide driver to move the abutment guide to a retracted position apart a predetermined length from the leading edges of the sheets.

6. The stacker according to claim 1, wherein the side guide is configured so that a user is allowed to select whether to position the side guide at a position where the sheet is supported from below by the side guide.

7. A machining processing device comprising:

a conveyor that conveys sheets;

a cutting part that cuts the sheets conveyed by the conveyor along a conveyance direction;

a placement part that stacks thereon the sheets cut by the cutting part and discharged from a discharge port by the conveyor;

a side guide that regulates edges of the sheets in a width direction intersecting a discharge direction of the sheets;

a guide driver that moves the side guide in the widthwise direction;

a controller configured to control the guide driver to position the side guide at a position where the sheet discharged from the discharge port is supported from below by the side guide; and a level sensor, wherein when the level sensor detects that the sheets stacked in the placement part have reached a predetermined height, the controller controls the guide driver to move the side guide to a position where the side guide does not support the sheet from below.

* * * * *